US006622349B2

(12) United States Patent
Wong

(10) Patent No.: US 6,622,349 B2
(45) Date of Patent: Sep. 23, 2003

(54) MAGNETIC STRAP FASTENER

(76) Inventor: Sheung Chung Wong, 1011-1016, A, B, C, 10/Fl., Block 1, Wang Cheong Factory Estate, 781, Lai Chi Kok Road, Cheung Sha Wan, Kowloon (HK)

( * ) Notice: Subject to any disclaimer, the term of this patent is extended or adjusted under 35 U.S.C. 154(b) by 0 days.

(21) Appl. No.: 09/920,015

(22) Filed: Aug. 2, 2001

(65) Prior Publication Data

US 2003/0019084 A1 Jan. 30, 2003

(30) Foreign Application Priority Data

Jul. 9, 2001 (HK) ..... 01104728

(51) Int. Cl.[7] ..... A44B 21/00
(52) U.S. Cl. ..... 24/303
(58) Field of Search ..... 24/303, 66.1; 292/251.2; 248/206.5; 335/285

(56) References Cited

U.S. PATENT DOCUMENTS 3,063,118 A 11/1962 Brown et al.
3,293,714 A * 12/1966 Shafer ..... 24/303
3,372,443 A * 3/1968 Daddonna, Jr. ..... 24/303
4,231,137 A * 11/1980 Fujimoto ..... 24/303
5,050,276 A * 9/1991 Pemberton ..... 24/303
5,432,986 A * 7/1995 Sexton ..... 24/303
5,664,298 A * 9/1997 Nessar-Ivanovic ..... 24/303
6,282,760 B1 * 9/2001 Mars ..... 24/303
6,292,985 B1 * 9/2001 Grunberger ..... 24/303

FOREIGN PATENT DOCUMENTS

| | | |
|---|---|---|
| DE | 23 23 058 | 11/1974 |
| EP | 0 490 663 | 6/1992 |
| EP | 0 923 887 | 6/1999 |
| JP | 58-108716 | * 6/1983 |

* cited by examiner

*Primary Examiner*—James R. Brittain
(74) *Attorney, Agent, or Firm*—Burns, Doane, Swecker & Mathis, LLP

(57) ABSTRACT

A strap fastener comprising a pair of engageable magnetic fasteners of opposite polarity to each other engageable on a common axis, a strap engagement portion connected to each magnetic fastener and extending transverse to said common axis of engagement of said magnetic fasteners; and at least one protrusion to reside against a perimeter of an opposed magnetic fastener to resist movement of one magnetic fastener with respect to the other transverse to said common axis on which they engage.

21 Claims, 2 Drawing Sheets

MAGNETIC STRAP FASTENER

FIELD OF THE INVENTION

The present invention relates generally to buckles and belt or strap fasteners and, more particularly, to magnetic fasteners such as magnetic buckles and magnetic strap fasteners. More specifically, although not solely limiting thereto, the present invention also relates to fasteners or buckles for use in or with a brassiere or the like.

BACKGROUND OF THE INVENTION

Unlike conventional fastener assemblies such as an array of buttons in which a button is fastened and released by inserting it into or removing it from a button hole, magnetic buttons and fasteners are fastened or secured by mutual magnetic attraction between a complementary pair of magnetic fasteners or buttons having complementary or opposite magnetic properties. This unique property of magnetic fasteners means that they can be automatically fastened when a detachable pair is in the proximity of each other. At the same time, coupled magnetic buttons can be separated simply by pulling the fasteners or buttons apart and move them away from each other. Also, unlike conventional fasteners such as button assemblies which have to be fastened and released sequentially, an array of magnetic buttons can be simultaneously fastened or released.

The above distinctive characteristics find magnetic fasteners particularly useful in circumstances in which the fasteners are required to be done and undone with a single hand and within a short time. For example, magnetic fasteners are useful in costumes for artists or performers who need to change frequently on stage. They are also useful for workers who wear work clothes and vests which may be caught by machinery or moving objects. Clothes or work vests with magnetic buttons provide easy escape to save the wearer from being caught and hurt when the clothes or vests are engaged accidentally.

As mentioned above, typical magnetic buttons include a pair of complementary parts which are releasably attachable to each other by magnetic attraction. Each of the detachable parts usually includes a magnetic member in slab or tablet form having a top and a bottom magnetic coupling surfaces with the opposite magnetic poles formed on them. The magnetic coupling surfaces are usually interconnected by a continuous peripheral edge which is usually quite thin for aesthetic and styling consideration. The magnetic slabs or tablets are usually cylindrical in shape with substantially identical top and bottom surfaces.

The magnetic slabs or tablets are generally enclosed in a magnetic permeable housing which are made, for example, of rubber, Nylon, fabrics, plastics (such as ABS or PVC) or synthetic resin. The housing makes decoration to the magnetic fasteners possible by providing a cover of aesthetic design to the magnetic member which usually has a monotonous and dull metallic appearance as well as providing weathering shield to the magnetic material to slow down or retard undesirable rusting. In this regard, the enclosure is preferably water- or air-tight so that even if the magnet member is oxidized, the enclosure still provides a cosmetic cover to hide the rusted surfaces from the outside, thereby making magnetic buttons suitable for applications in which product presentation and appearance are important.

To further enhance the convenience and usefulness of magnetic fasteners, magnetic fasteners are always made with complementary magnetic members having identical shapes and dimensions. As a result of the substantially identical dimensions of the complementary magnetic coupling surfaces on the detachable parts, the parts will come into substantially automatic alignment once they come into contact and no external help is therefore required in general for the initial contact and the subsequent engagement.

In view of the many advantages offered by magnetic buckles, it will be expected that magnetic belt or strap fasteners or buckles should be much more widely used, for example and especially, in applications where the buckles are hard to reach or locate or in applications where the buckles are normally concealed underneath other surfaces during use. One example of such applications is in lingeries or brassieres where the buckles are usually located at the back or at locations which are not conveniently accessible. Another example is for braces in which some of the fasteners are to be fastened to the back of trousers. In these applications, the appearance of the fasteners is usually important as their selection is sometimes considered to be representative or reflective of the taste of the user. Hitherto, magnetic buckles are not as widely used as expected in such applications. One main reason for this is probably because conventional magnetic fasteners buckles are very complex, of a bulky build and are expensive, heavy and un-sightly and sometimes difficult to use. Another reason is the fear of accidental disengagement. More importantly, since magnetic buttons are characterised by engagement by mutual magnetic attraction of the coupling surfaces having opposite or complementary magnetic polarities and since magnetic coupling forces are usually strongest in the direction which is substantially normal or perpendicular to the coupling surfaces, the mutual lateral attraction is relatively week and lateral dislocation of the buttons may occur relatively easily by lateral pulling of the buttons which may cause inadvertent or accidental disengagement of the fasteners when a lateral tension is applied. While it may be possible to retard undesirable lateral movement by providing matted or frictional coupling surfaces, this would usually decrease the ease of self alignment between the coupling surfaces and are therefore is not an attractive option.

Hence, it will be desirable if magnetic buckles having at least some of the aforementioned shortcomings overcome or alleviated can be provided so that light, reliable and simple strap fasteners can be provided. Preferably such strap fasteners should have a low-profile structure which allows decoration to be conveniently and easily added to the buckles to make them more aesthetically pleasing—an important aspect if magnetic buckles are to be widely used in lingerie, fashions or apparel. In addition, a low-profile structure usually alleviates the risks of damages to the covering or adjacent soft materials. Naturally, it is highly desirable if such fasteners can be snap-fitted and easily disengageable as and when desired by the user.

Throughout this specification, the terms fasteners, buckles and buttons are used interchangeably for brevity and succinctness to the extent that is appropriate for the context.

OBJECT OF THE INVENTION

It is therefore an object of the present invention to provide a magnetic strap fastener or buckle which is light, of a simple structure and inexpensive. In addition, the strap fastener or buckle should have a low-profile build so that it can be easily and conveniently concealed under clothes or other surfaces for aesthetic consideration so that such fasteners can be generally used in the manufacture of underclothings such as brassieres and lingeries. Preferably, in addition to the afore-mentioned requirements, the buckles should be reasonably reliable so that the risks of accidental dis-engagement of the buckles or strap fasteners are minimal. As a minimum, it is the object of the present invention to provide the public with a choice of a new form of magnetic fasteners as described herein.

SUMMARY OF THE INVENTION

According to the present invention, there is provided a magnetic buckle or strap fastener including a housing and a magnetic member, said magnetic member includes a first surface of a first magnetic polarity and a second surface of a second and opposite magnetic polarity, the perimeters of said first and said second surfaces are joined by a thin peripheral wall, said housing includes a holder for receiving said magnetic member so that at least one surface of said magnetic member will substantially expose and a strap receiving means extending away from said peripheral wall in a direction which is substantially perpendicular to said peripheral wall.

Preferably, the strap receiving means is substantially equi-distant from both polar surfaces of said magnetic member.

Preferably, the holder includes a base portion and a wall extending upwardly from the perimeter of said base portion, said base portion is adjacent one surface of said magnetic member and said wall is adapted to surround the peripheral wall of said magnetic member.

Preferably the wall discontinues at about the junction between said strap receiving means and said base portion.

Preferably, the holder includes a wall surrounding the peripheral wall of said magnetic member, said wall includes an elevated portion protruding beyond the exposed magnetic surface.

Preferably, the elevated portion is adapted so that when said strap fastener is magnetically coupled with a counterpart strap fastener of the same design, said elevated portion will not push against the strap receiving means of the counter-part fastener while forming a barrier member to stop relative lateral movement along the directions of the strap receiving means.

According to another aspect of the present invention, there is provided a strap fastener or a buckle including a housing and a magnetic member, said magnetic member includes a first and a second magnetic polar surfaces respectively of a first and a second magnetic polarities which together define a magnetic axis, said housing includes a receptacle for receiving said magnetic member and a strap receiving means, said strap receiving means is formed on said receptacle and is transverse to said magnetic axis.

Preferably, the strap fastener further including a projection which is disposed on the edge of said receptacle at a position which is substantially opposite to said strap receiving means and which extends beyond the magnetic polar surface which is adapted for coupling with a counterpart magnetic coupling surface.

According to yet another aspect of the present invention, there is provided a buckle or strap fastener comprising a pair of engageable magnetic fasteners of opposite polarity to each other engageable or a common axis and a strap engagement portion connected to each magnetic fastener and extending transverse to said common axis of engagement of said magnetic fasteners. Preferably, said fastener includes at least one protrusion to reside against a perimeter of an opposed magnetic fastener to resist movement of one magnetic fastener with respect to the other transverse to said common axis on which they engage.

BRIEF DESCRIPTION OF THE DRAWINGS

Preferred embodiments of the present invention will now be explained by way of examples and with reference to the accompanying drawings in which.

DETAILED DESCRIPTION OF THE PREFERRED EMBODIMENTS

Figure 1:
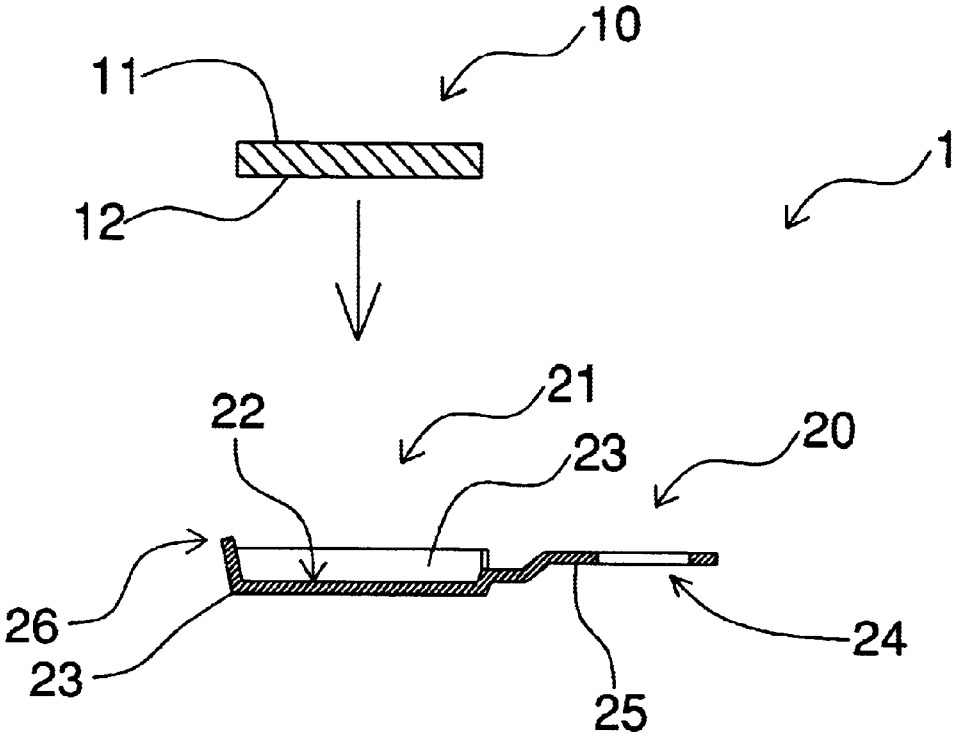
FIG. 1 illustrates the cross-sectional of a magnetic member and a housing to be described in the first embodiment of the present invention.
Figure 2:
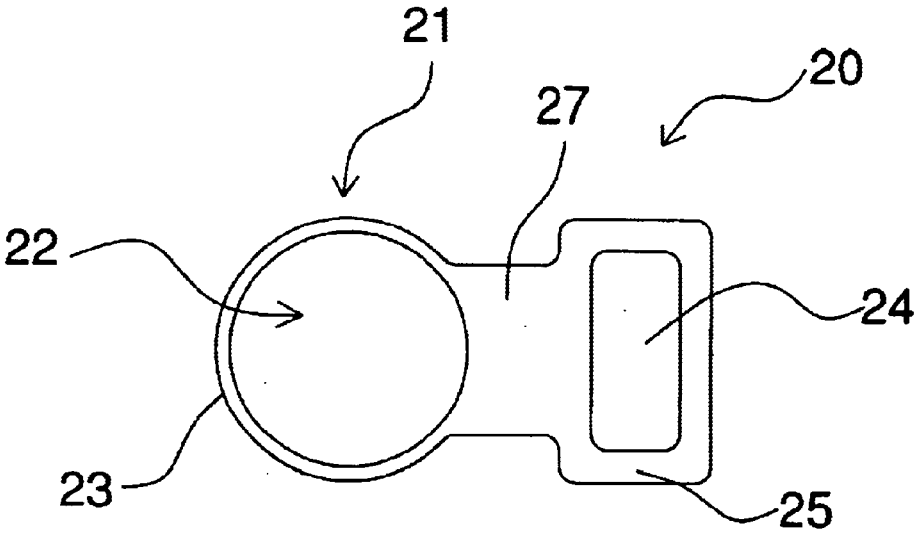
FIG. 2 shows the top plan view of the housing of FIG. 1.
Figure 3:
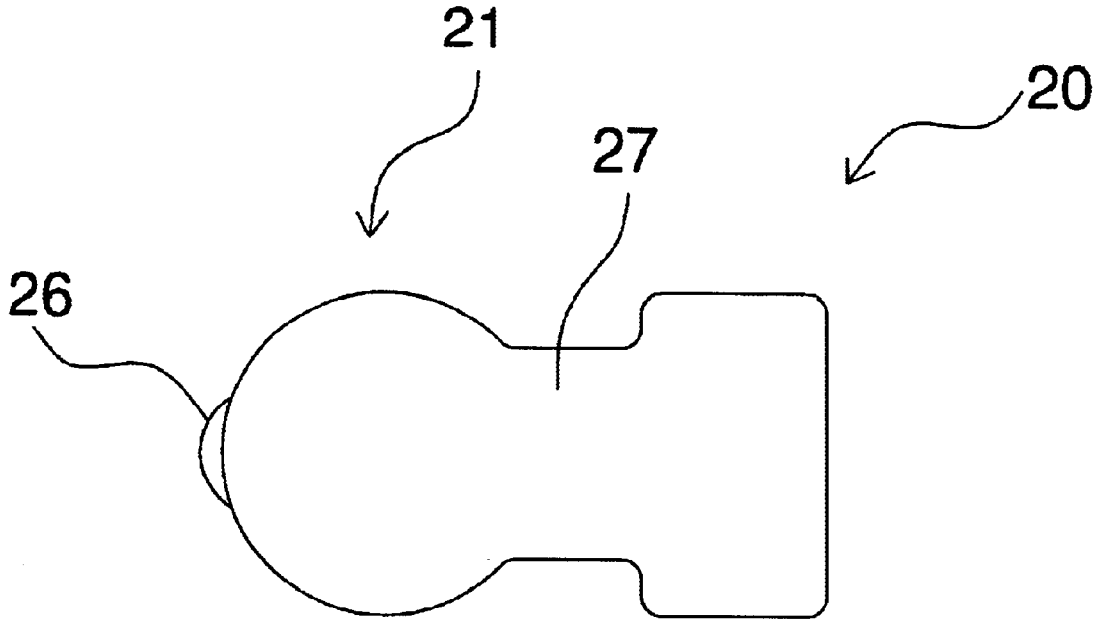
FIG. 3 is a diagram showing generally the housing and indicating a protruding portion extending from the peripheral wall of the holder to alleviate undesirable relative lateral slippage of a buckle pair.

Referring firstly to FIGS. 1 to 3, there are shown a magnetic member (10) and a housing (20) which, when assembled together, form a first preferred embodiment of the present invention of a magnetic buckle. The magnetic member (10) is the source of the magnetic coupling force for engaging with a counterpart magnetic buckle. Preferably, this magnetic member includes a permanent magnet in the form of a magnetic slab made of a strong magnetic substance or alloy in order to provide a large magnetic force-to-volume ratio essential for a compact buckle design. With the current magnetic technology, a pair of complementary magnetic slabs having a diameter of 1 cm and a thickness of about 1 mm and with an appropriate design as mentioned herein can produce a magnetic coupling force of up to 20–30 N.

In the present preferred example, the magnetic slab is substantially circular or cylindrical with a diameter of about 12 mm and a thickness of less than 1 mm. To provide a maximum magnetic coupling area, the two opposite magnetic poles are preferably disposed on the two opposing planes (11, 12) of the magnetic slab so that the North pole is on one of the planar surfaces while the South pole is on the other. To increase the magnetic flux intensity on the coupling surface, the magnet member is preferable embedded within a casing made of a magnetic material, such as an iron, steel or other ferro-magnetic casing, with the magnetic coupling surface exposed. With such an embedment of a strong magnet on a ferro-magnetic casing, the magnetic strength of the exposed coupling surface is considerably strengthened by concentration. Of course, magnetic members of other shapes and thickness can equally be used without loss of generality. For example, the magnetic member can be made into a rectangular, polygonal, trapezoidal or even irregular or non-geometric cross-section. In addition, a ring- or toroidal shaped magnetic member can also be utilized.

The housing includes a holder portion (21) or receptacle for receiving the magnetic member and a strap receiving portion (25) for anchoring a flexible end of a strap for releasable engagement with a counter-part magnetic buckle. The magnetic member holder portion includes a base portion (22) which preferably conforms closely to the base dimensions of the magnetic member and an upstanding fencing wall (23) which extends upwardly along the perimeter of the base portion. The combined structure of the base portion together and the peripheral fencing wall provides a cavity casing within which the magnetic member is received with the magnetic coupling surface (11) exposed and unobstructed. The cavity casing, which includes the base portion (22) and the upwardly extending parametric peripheral wall (23), is preferably made of a magnetic material, for example, a ferro-magnetic substance such as chromium or Nickel plated steel. The magnetic member can be glued to the cavity housing or retained by other means, including mechanical retention or embedment. When the magnetic member is enclosed by a magnetic material in this manner, the magnetic strength of the exposed magnetic surface will be reinforced and the magnetic coupling forces, when coupled with the opposite magnetic surface (10) of a similarly designed counterpart magnetic buckle, will be greatly enhanced when compared to magnetic members not so encased. With such a design, a more compact buckle with a strong magnetic strength can be provided.

The strap receiving portion (25) includes a means (24) for receiving or otherwise connecting to the flexible end of a flexible strap. To enhance secured retention of the strap, the receiving portion may include a serrated slot or notch.

The strap receiving portion (25) includes a means (24) for receiving the flexible end of a flexible strap in order to form a strap with a buckled end. To improve better retention of the strap end, the receiving portion may include a serrated slot or notch. In order to provide a low-profile buckle design, the strap receiving portion is relatively thin with a thickness which is preferably equal to or less than that of the peripheral wall of magnetic member. In addition, the strap receiving portion is preferably formed by placing it adjacent to the peripheral edge joining the magnetic polar surfaces rather than extending from either polar surfaces so that an over-all low-profile structure can be obtained.

In the present embodiment, the strap receiving portion contains a rigid bridging portion which extends away from the cavity casing in a lateral or radial manner. In this arrangement, the strap receiving portion is substantially equi-distant from both polar surfaces and is joined to the cavity casing by the rigid bridging portion (27). The bridging portion (27) preferably includes a ribbon-shaped plate member with its wide surfaces substantially parallel to the magnetic coupling surfaces (11, 12). Of course, instead of ribbon shaped member, a thin shaft member may be used to join the strap receiving portion and the cavity casing. In any event, the portion of the housing which extends away from the cavity casing should be of a slim design so that an overall low-profile design can be achieved. For example and as shown in the Figures, a substantial portion of that extension is preferably flat and the whole portion should be kept within the height of the peripheral wall of the magnetic member (10). Alternatively, the strap-receiving means may be formed proximate and adjacent to the peripheral wall joining the polar surfaces (11, 12) so that it is substantially equidistant from both polar surfaces (11, 12). Forming the strap-receiving means sidewise of the polar surfaces will always provide a desirable low-profile structure.

Figure 4:
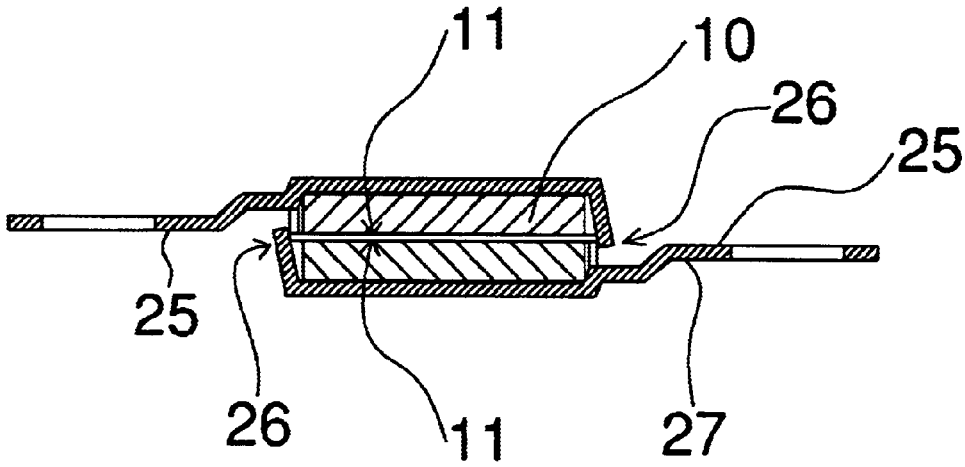
FIG. 4 is a cross sectional view illustrating a pair of the buckles engaged together.

Referring now to FIG. 4 in which there are shown a pair of complementary counterpart magnetic buckles in magnetic engagement, it can be seen that the magnetic coupling surfaces of the counterpart buckles A and B with magnetic coupling surfaces (11) of the opposite magnetic polarities are in physical contact. It should be noted that while it is preferable that both of the complementary buckles are of the same structural design as mentioned herein, a buckle of a different design but of a complementary nature can be used as a counterpart buckle or fastener.

As can be seen from this Figure, the laterally or radially extending strap receiving portions help to reduce the overall thickness of the engaged buckle pair, making the assembly particularly suitable for use in circumstances, for example in lingerie and brassiere applications, where a thin assembly is desirable.

Furthermore, in order to alleviate the risks of undesirable or accidental disengagement of the magnetically coupled buckle pairs, the portion of the peripheral wall at the end of the cavity casing directly opposing the strap receiving portion is made with a small projection or with an elevated teeth (26) resembling portion. The protruding portion (26) of the buckle is formed on the cavity wall (23) and extends beyond the surface of its magnetic coupling surface (11). This projection (26) will become a barrier member to the magnetic member (10) of the counterpart buckle by extending also beyond the magnetic coupling surface (11) of the counterpart buckle. With the elevated portion engaging with the edge of the magnetic member of the corresponding counterpart buckle, undesirable lateral slippage in both the left and right directions, i.e., directions along both strap receiving portions can be greatly alleviated. When the buckles are to be un-coupled, a user only needs to slightly lift one of the buckles, for example, by pivoting against the counterpart buckle and then separating the buckles. To ensure sufficient space for accommodating the protruding member (26) without having to press against the bridging portion, a slight indentation corresponding to the location of the protruding portion is preferably provided so that the teeth (26) can rest above and away from the bridging portion. This slight indentation may also be accompanied by a discontinuation of the perimetric wall at the corresponding position to allow engagement of the teeth member. As shown in the Figures, the indentation is formed at the intersection or junction between the bridging portion and the cavity housing.

In the present specific example, the housing is integrally formed of a magnetic material so that one of the magnetic surfaces is in contact with the base portion while the peripheral wall of the magnetic member is enclosed within the cavity housing, leaving the magnetic coupling surface exposed. Where a ring- or toroidal-shaped magnet member is used, the cavity housing may have a hollow base portion. To provide a decoration or an aesthetic design, the buckle may be enclosed within a thin magnetic permeable enclosure made, for example of, PVC, synthetic resins, rubber, Nylon or the like material. Furthermore, while the permanent magnet (10) is held by a holder portion which is made preferably of a magnetic material in order to strength the magnetic force on the exposed polar surface of the permanent magnet, it should be appreciated that the present invention can be made by having a magnetic enclosed within a housing which does not have the effect of concentrating the magnetic strength on a particular polar surface as long as there is provided a strap receiving means transverse or side-wise to the magnetic axis of the permanent magnet.

While the present invention has been explained by reference to the preferred embodiments above, it should be appreciated that the embodiments are provided for illustration and assisting understanding only and do not intend to limit or restrict the scope of the present invention.

What is claimed is:

1. A strap fastener including a housing and a magnetic member, said magnetic member including a first magnetic surface of a first magnetic polarity and a second magnetic surface of a second and opposite magnetic polarity, the perimeters of said first and said second surfaces being joined by a thin peripheral wall, said housing including a holder with a base portion for receiving said magnetic member so that said first magnetic surface of said magnetic member is proximal and adjacent to said base portion of said holder and said second magnetic surface is distal from said base portion of said holder, said fastener including a strap receiving means which extends away from said holder along a direction which is substantially parallel to said second magnetic surface, said holder further including an elevated portion extending from said base portion of said holder and protruding beyond said second magnetic surface of said magnetic member, said elevated portion being generally opposite to said strap receiving means and said magnet member being intermediate said elevated portion and said strap receiving means, said fastener further including an indented portion for complementarily receiving the elevated portion of a complementary counterpart magnetic fastener, said indented portion being generally complementary to said elevated portion and being disposed generally opposite to said elevated portion and intermediate said magnetic member and said strap receiving means.

2. The strap fastener of claim 1, wherein said indented portion for receiving the elevated portion of a counterpart fastener is intermediate said peripheral wall of said magnetic member and said strap receiving means, and wherein said elevated portion, said indented portion and said strap receiving means are generally disposed along a straight line.

3. The strap fastener of claim 2, wherein said peripheral wall of said magnetic member is substantially circular and said elevated portion is located substantially diametrically opposite the junction between said magnetic member and said strap receiving means.

4. The strap fastener of claim 3, wherein said elevated portion also extends along a minor portion of said peripheral wall of said magnetic member and follows the curvature of said peripheral wall.

5. The strap fastener of claim 1, wherein said holder includes a side wall extending upwardly from said base portion and surrounding a major portion of said peripheral wall of said magnetic member, and wherein said elevated portion protrudes from said side wall and extends along a minor portion of said side wall.

6. The strap fastener of claim 5, wherein an upper side of said side wall is generally level with said second magnetic surface of said magnetic member, said upwardly extending side wall discontinues at the junction between said strap receiving means and said magnetic member so that said peripheral wall of said magnetic member is communicable with said indented portion, and said discontinuity also defines the limits of said indented portion along said magnetic member for receiving the elevated portion of a counterpart fastener.

7. The strap fastener of claim 5, wherein the protrusion of said elevated portion of said holder above said second magnetic surface and the depth of said indented portion are such that when said strap fastener is complementarily coupled with a counterpart fastener, said second magnetic surface and the corresponding second magnetic surface of the counterpart fastener are substantially parallel.

8. The strap fastener of claim 5, wherein an upper side of said side wall is substantially level with said second magnetic surface of said magnetic member, such that when said fastener is coupled with a counterpart fastener, the corresponding magnetic surfaces and the side walls of the coupled fasteners are in substantial contact.

9. The strap fastener of claim 5, wherein said magnetic member is substantially circular and said elevated portion is located substantially diametrically opposite said indented portion.

10. The strap fastener of claim 9, wherein said indented portion generally extends along the peripheral wall of said magnetic member at about the junction of said magnetic member and said strap receiving means, and wherein said indented portion generally follows the curvature of said peripheral wall and is long enough to allow translation of the elevated portion of a counterpart fastener of matching design along said indented portion when said fastener is coupled with a counterpart fastener.

11. The strap fastener of claim 9, wherein said side wall is generally circular and substantially follows the curvature of said peripheral wall of said magnetic member, and said elevated portion also substantially follows the curvature of said side wall.

12. The strap fastener of claim 1, wherein said second magnetic surface of said magnetic member is substantially exposed, said holder includes a side wall extending upwardly from said base portion and surrounding a substantial portion of said peripheral wall of said magnetic member, and said side wall of said holder is made of a ferro-magnetic material.

13. The strap fastener of claim 12, wherein said indented portion for complementarily receiving the elevated portion of a counterpart fastener is intermediate said peripheral wall of said magnetic member and said strap receiving means, and wherein said elevated portion, said indented portion and said strap receiving are generally disposed along a straight line.

14. The strap fastener of claim 12, wherein an upper side of said side wall is generally level with said second magnetic surface of said magnetic member, said upwardly extending side wall discontinues at the junction between said strap receiving means and said magnetic member so that said peripheral wall of said magnetic member is communicable with said indented portion, and said discontinuity also defines the limits of said indented portion along said magnetic member for receiving the elevated portion of a counterpart fastener.

15. The strap fastener of claim 14, wherein said elevated portion of said holder is elevated above said side wall and opposite said discontinuity on said side wall.

16. The strap fastener of claim 14, wherein said magnetic member is substantially circular, said elevated portion is located substantially diametrically opposite the junction between said magnetic member and said strap receiving means, said indented portion generally extends along the peripheral wall of said magnetic member and along the junction between said magnetic member and said strap receiving means, and said indented portion generally follows the curvature of said peripheral wall and is long enough to allow translation of the elevated portion of a counterpart fastener of matching design along said indented portion when said fastener is coupled with a counterpart fastener.

17. The strap fastener of claim 14, wherein said side wall is generally circular and substantially follows the curvature of said peripheral wall of said magnetic member, and said elevated portion also substantially follows the curvature of said side wall.

18. The strap fastener of claim 12, wherein said holder, said indented portion and said strap receiving means are integrally formed from a magnetic material.

19. The strap fastener of claim 18, wherein said strap receiving means includes a generally planar strap receiving member which is substantially parallel to said second magnetic surface and includes a strap receiving slot on said member.

20. A complementary pair of strap fasteners, said pair including the fastener of claim 1 and a magnetic fastener complementary to said fastener of claim 1.

21. A complementary pair of strap fasteners, said pair including the fastener of claim 12 and a magnetic fastener complementary to said fastener of claim 12.

* * * * *